US007033307B2

(12) United States Patent
Van Straaten

(10) Patent No.: US 7,033,307 B2
(45) Date of Patent: Apr. 25, 2006

(54) EXERCISE DEVICE

(75) Inventor: Willem Johannes Van Straaten, Sandton (ZA)

(73) Assignee: Greenhouse International LLC, Elkton, MD (US)

( * ) Notice: Subject to any disclaimer, the term of this patent is extended or adjusted under 35 U.S.C. 154(b) by 77 days.

(21) Appl. No.: 10/639,525

(22) Filed: Aug. 13, 2003

(65) Prior Publication Data

US 2004/0033873 A1 Feb. 19, 2004

(30) Foreign Application Priority Data

Aug. 15, 2002 (ZA) ..... 2002/3287

(51) Int. Cl.
*A63B 26/00* (2006.01)

(52) U.S. Cl. ..... 482/142; 482/140; 482/907

(58) Field of Classification Search ..... 482/142, 482/140, 907, 91; 446/220; 5/630–640, 5/654; 606/240; 128/845
See application file for complete search history.

(56) References Cited

U.S. PATENT DOCUMENTS

| | | | | | |
|---|---|---|---|---|---|
| 3,142,932 | A | * | 8/1964 | Lemelson | 446/220 |
| 4,902,003 | A | * | 2/1990 | Buoni | 482/140 |
| 5,033,742 | A | * | 7/1991 | Johnson et al. | 482/140 |
| 5,147,267 | A | | 9/1992 | Kunewalder | |
| 5,584,786 | A | | 12/1996 | Almeda | |
| 5,605,526 | A | | 2/1997 | Hatfield | |
| 5,795,276 | A | | 8/1998 | Almeda | |
| 5,803,884 | A | | 9/1998 | Sharp | |
| D418,563 | S | * | 1/2000 | Hwang | D21/688 |

* cited by examiner

*Primary Examiner*—Gregory L. Huson
*Assistant Examiner*—L. Amerson
(74) *Attorney, Agent, or Firm*—Wenderoth, Lind & Ponack, L.L.P.

(57) ABSTRACT

An exercise device which includes a structure with a lower outwardly extending ground-engaging surface, an upper surface which includes a seat formation for a user positioned so that a user, seated on the seat formation, can place his feet on the ground, and an upwardly extending back-supporting surface.

5 Claims, 5 Drawing Sheets

EXERCISE DEVICE

BACKGROUND OF THE INVENTION

This invention relates to an exercise device.

A person who is exercising can have a fitness level which can vary from totally unfit to highly or super fit. Any exercise device which is made for general usage should, within reason, be capable of being adapted or adjusted to take account of the different fitness levels of the various users. Such fitness levels are not known in advance, nor at the time of manufacture or sale of the exercise device. Consequently it is desirable for a user to be able to adjust or vary the exercise device to take account of his particular fitness level. For example, if a person is fairly fit, then the particular exercise device should be usable in a manner which requires a relatively high energy input from the user. Conversely if the user is unfit then the energy level required, in using the device, should be relatively low.

A person who is exercising will, irrespective of that person's fitness level, ultimately reach a point at which the energy output of which the person is capable, will be reduced. If that person is, for example, intent on completing a particular exercise routine while using an exercise device then it is desirable for the person to be able to adjust the device, during use, to take account of his state of tiredness at the time. For example, the device should be adjustable or variable so that less effort is required, as a person tires, to go through an exercise routine.

SUMMARY OF INVENTION

The invention provides an exercise device which includes a structure with a ground-engaging surface and an upper support surface upon which at least part of the back of a user is supportable at an orientation which is variable relative to the ground.

To achieve the variation in orientation referred to, the back of the person may be positioned on different portions of the upper support surface. The upper support surface may include for example, at least two formations at different inclinations relative to the ground-engaging surface or may be contoured or shaped, to a desired outline, relative to the ground-engaging surface.

The structure may include a body and the upper support surface may be movable, within limits, relative to the body. The upper support surface may, for example, be pivotally movable relative to the body. The upper support surface may, for example, engage with the body by means of a pivot connection, by means of flexible supports, or in any other appropriate way which allows the upper support surface to be moved relative to the body.

Alternatively or additionally the ground-engaging surface is shaped so that different portions thereof engage with the ground as the orientation of the structure, relative to the ground, is varied.

The ground-engaging surface may be curved, from one end of the body to an opposing end, in any appropriate shape. Preferably, in this form of the invention, the ground-engaging surface is curved so that it bulges outwardly, i.e. is generally of convex form.

The ground-engaging surface may be continuously variable, i.e. without discontinuities in the ground-engaging surface.

In a different form of the invention the ground-engaging surface is discontinuous and has a plurality of surface portions which are respectively engageable with the ground, according to requirement, as the orientation of the structure is varied. With this form of the invention, the orientation of the structure, or the body, is adjustable relative to the ground in a step fashion.

The body may be rigid or substantially rigid.

In one form of the invention the body is made from a flexible yieldable material such as foam rubber or the like.

In a different form of the invention the body is inflatable.

The body may, for example, include a frame which is formed with a ground-engaging surface of any appropriate shape.

The structure, on an upper side, may include a first defined region, which is recessed, for a seat of a user and a second defined region which is curved outwardly and which forms the upper support surface for the back of a user.

In one form of the invention the ground-engaging surface is movable, relative to the ground, with a rotating or tipping action, as a user moves his feet or lower legs, which are supported on the ground, relative to the structure.

The structure may include handles which can be gripped by a user during use of the exercise device.

The invention also provides an exercise device which includes a structure which is formed from an inflatable body and which has a convex ground-engaging surface and an upper side which has opposed rounded upper and lower ends, a recessed seat region adjacent the rounded lower end, and a convex support surface between the recessed seat region and the rounded upper end and wherein a user, by changing his weight distribution on the upper side, can cause a different portion of the convex ground-engaging surface to contact the ground.

The invention also extends to an exercise device which includes a structure with a lower outwardly extending ground-engaging surface, an upper surface which includes a seat formation for a user positioned so that a user, seated on the seat formation, can place his feet on the ground, and an upwardly extending back-supporting surface.

BRIEF DESCRIPTION OF THE DRAWINGS

The invention is further described by way of examples with reference to the accompanying drawings in which.

DETAILED DESCRIPTION OF PREFERRED EMBODIMENTS

Figure 1:
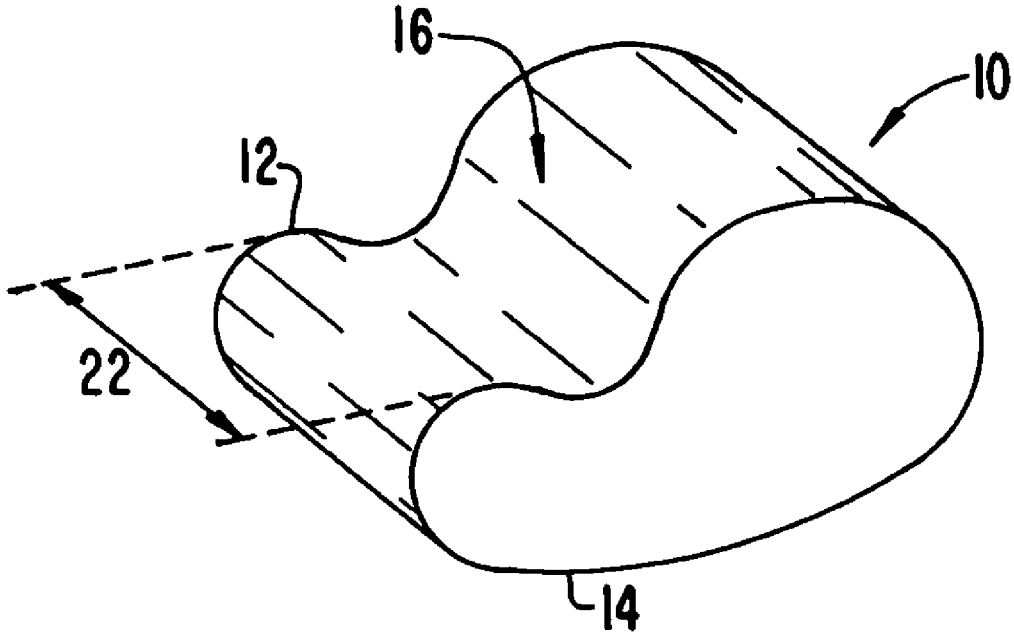
FIG. 1 is a perspective view of an exercise device according to one form of the invention.
Figure 2:
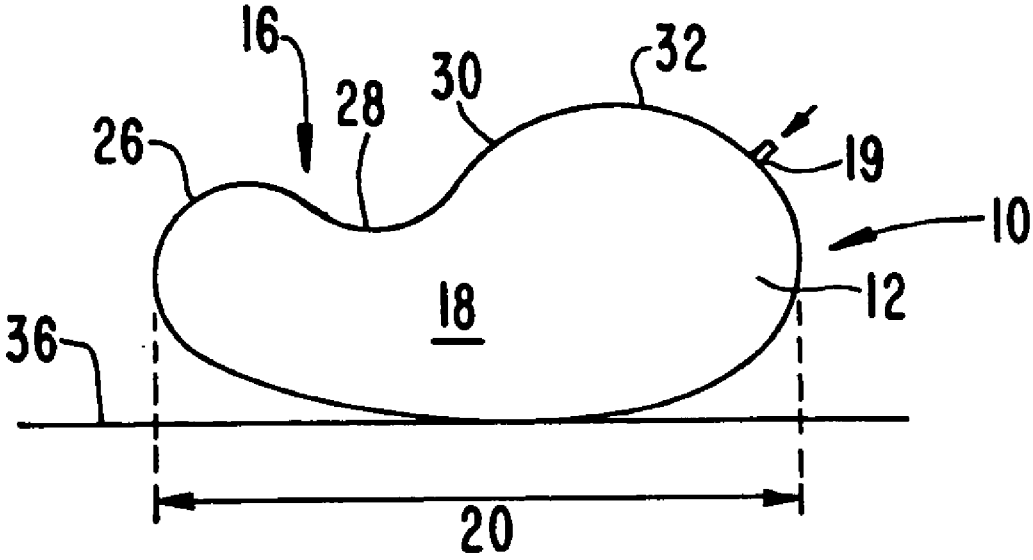
FIG. 2 is a side view of the exercise device of FIG. 1.

FIGS. 1 and 2 show an exercise device 10 according to a first form of the invention which includes a structure 12 with a lower ground-engaging surface 14 and an upper support surface 16.

The structure 12 may be formed in various ways and, in the example shown in FIG. 1, the structure 12 comprises an integral solid body 18 which is molded from a suitable slightly resilient material such as high density foam.

In an alternative form of construction, the body 18 is hollow and is molded in one-piece from a suitable material such as rubber or an equivalent material, which may be synthetic. In this respect use may be made of techniques which are the same as those used for the molding of large round rubber balls of the type used in gyms for exercising. These balls are inflatable or deflatable, according to requirement. Similarly the structure 12 may be integrally molded from rubber or a rubber-like material and may be inflatable through a valve 19 of known construction.

The length 20 of the structure may vary according to requirement but typically is of the order of 800 mm. The width 22 of the body may also vary according to requirement but a convenient width is of the order of 500 mm. The ground-engaging surface 14 is curved or bulges outwardly and generally may be said to have a convex shape. The upper support surface 16 is shaped with a bulging lower end 26, a recessed portion 28, an upwardly sloping surface 30 and a rounded upper end 32.

The body 18 is shown resting on a floor or ground 36. If no person is using the device then the device takes up a rest position substantially as shown in FIG. 2.

Figure 3:
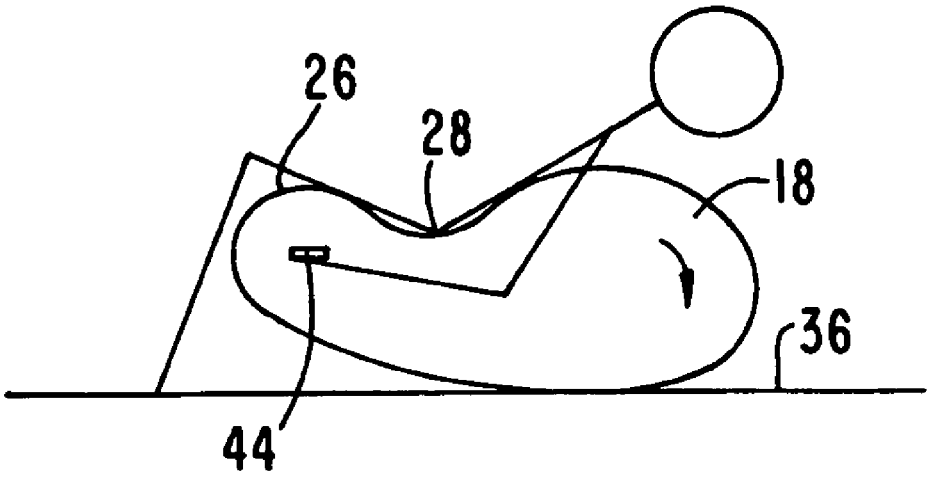
FIGS. 3 and 4 show the device of FIG. 1 in use.
Figure 4:
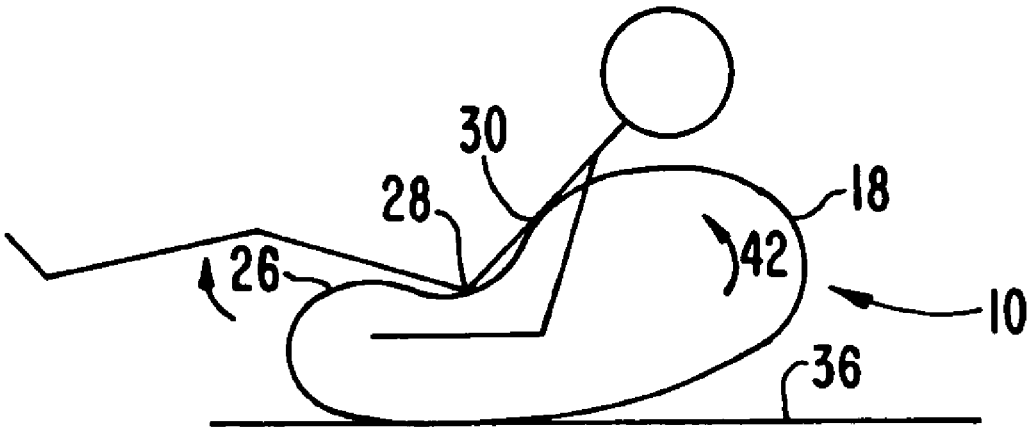

FIGS. 3 and 4 illustrate schematically the manner in which the orientation of the body 18 can be varied when a person is seated on the body. The recessed portion 28 acts as a seat for the user and the user's legs then cross over the bulging lower end 26 which is low enough so that the user's feet can rest on the ground 36 adjacent the lower end. If the user's lower legs (FIG. 3) are brought inwardly, so that they are close to the lower end 26, then the center of gravity of the user (the user's weight distribution) and the body 18 is shifted to the right and there is a tendency for the body to rotate in a clockwise direction. On the other hand if the user's lower legs are moved away from the bulging lower end 26 (see FIG. 3) then the center of gravity of the user and the body 18 is shifted to the left and there is tendency for the body to rotate in an anticlockwise direction as is indicated by means of an arrow 42. The user's weight distribution can be varied as indicated, by movement of the legs close to, or further from, the body 18, or by moving the user's position on the body, or by a combination of both activities.

The upwardly sloping surface 30 is designed to support the back of a user. As the inclination of the body 18 is changed, in the manner described, the angle at which the surface 30 extends upwardly, relative to the floor 36, also changes. The user's back, which rests on the surface 30, undergoes a corresponding change in orientation.

The device 10 is designed to provide support for a person who does exercises such as sit-ups, while seated on the upper surface 16. If the body 18 is rotated to a maximum extent in an counter-clockwise direction then the user is seated nearly vertically and the amount of effort required to do sit-ups is comparatively low. The degree of effort required to do sit-ups increases as the body 18 rotates in a clockwise direction for the user's back effectively is lowered towards the floor 36. At the same time, as has been pointed out, the user's lower legs are moved away from the bulging lower end 26 of the body and the effort required to do a sit-up and the length of an arc through which the user's back is moved during a sit-up, are increased.

The device 10 can be used by persons of different fitness levels with its orientation being adjusted, in each case, by the respective user moving his legs inwardly or outwardly relative to the lower end 26. Similarly, a person of a given fitness level who is using the device 10 can adjust the orientation of his body to take account of his energy level or state of tiredness at any time.

It is preferable that the body 18 has a slightly resilient upper surface so that it provides effective and comfortable support for a user who reclines fully on the upper surface. As shown in FIG. 3, handles 44 can be provided on opposed sides of the body to provide grips which help the user during exercise.

Figure 5:
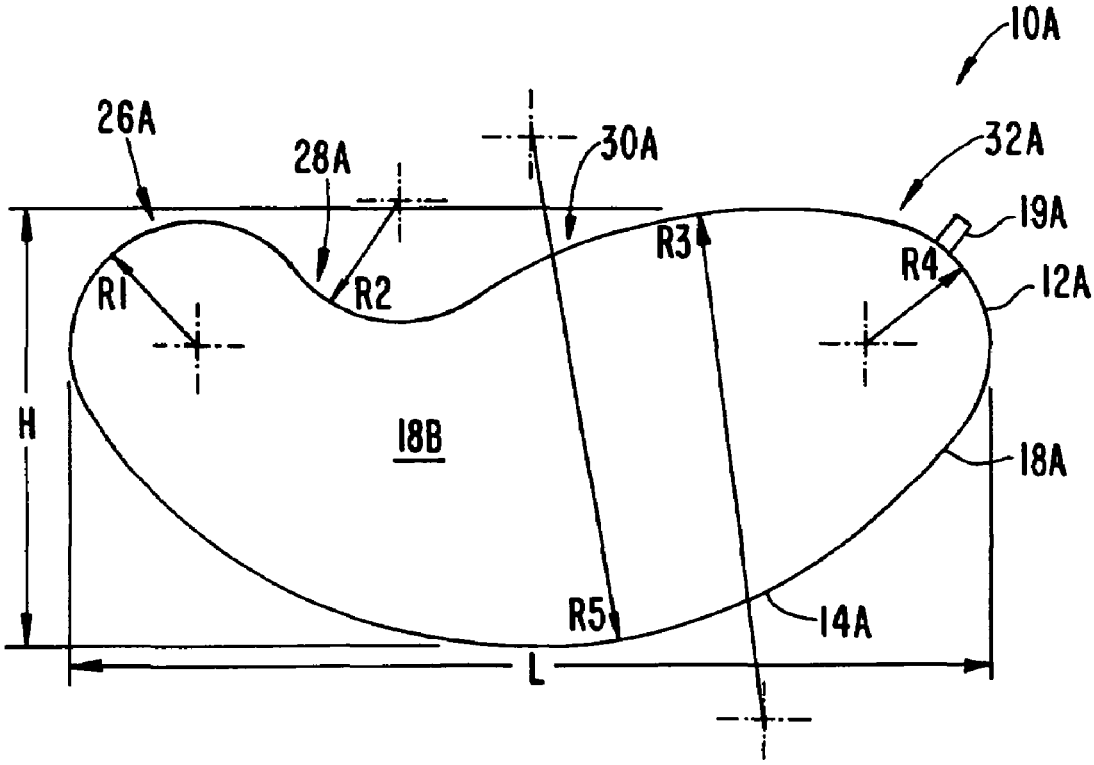
FIG. 5 shows a preferred set of relationships, which at least partly determine the shape of the device shown in FIGS. 1 to 4.

FIG. 5 is a cross-sectional side view of a device 10A wherein the structure 12A is bag-like and includes a tough, flexible skin 18A integrally molded as a one-piece component from rubber or a rubber-like material. The device has a hollow interior 18B which can be pressurized with air which is forced through a filler valve 19A using a suitable pump (not shown).

When inflated the structure 12A takes up the illustrated cross-sectional shape.

The structure has a rounded lower end 26A with a radius of curvature R1, a recessed portion 28A with a radius of curvature R2, an upwardly sloping surface 30A with a radius of curvature R3, a rounded upper end 32A with a radius of curvature R4, and a ground-engaging surface 14A with a radius of curvature R5. Through experimentation it has been found that the device 10A is particularly suitable for use by a wide range of users when:

R1≅R2≅R4; and

R3≅R5.

Suitable values are: 110≦R1≦120 mm; and

470≦R3≦490 mm.

Preferred values are: R1=115 mm; and R3=480 mm.

The length L of the device, with the aforementioned preferred radii of curvature, lies between 800 and 900 mm and is preferably 850 mm. The height H of the device lies between 420 and 440 mm and is preferably 430 mm.

The device 10A is intended to be usable by a wide range of users, with physiques which can differ substantially from each other and the fitness levels of the users can vary considerably. Given these constraints the aforementioned values, which have been arrived at through considerable experimentation, have been found to represent a good combination of variables which makes the device acceptable to most potential users.

Figure 6:
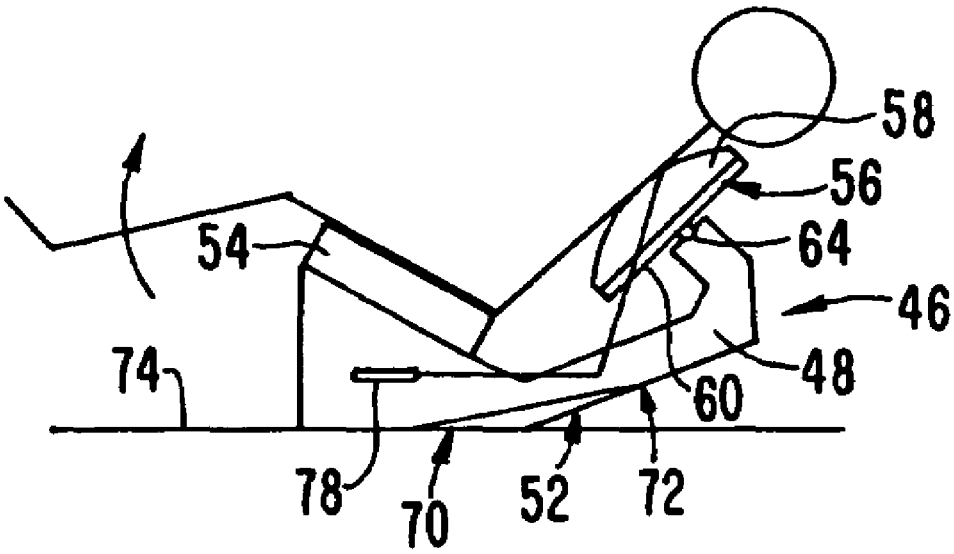
FIGS. 6 and 7 show an exercise device according to a second form of the invention.
Figure 7:
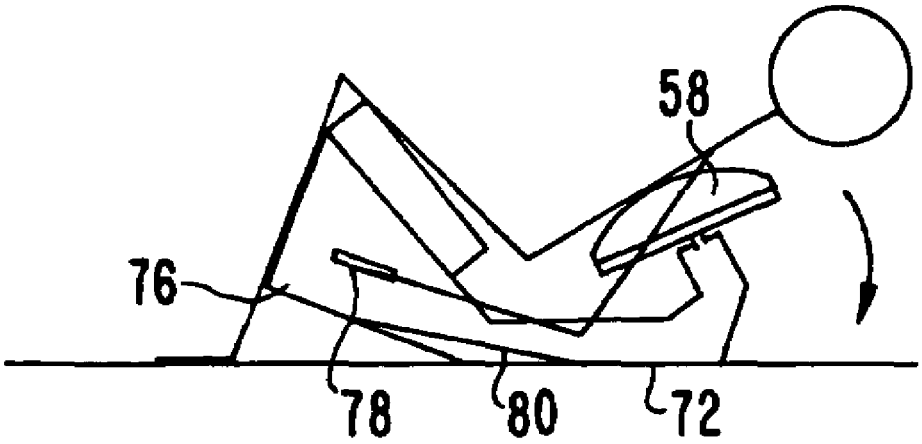

FIGS. 6 and 7 illustrate a device 46 which is similar, in concept, to the device 10 even though it has a substantially different construction.

The device 46 includes two spaced parallel substantially identical frame members 48 (only one of which visible) which define a ground-engaging surface 52 for the device. A seat 54 is fixed to lower ends of the frame members 48 while a back rest 56 bridges upper ends of the frame members. The back rest has a cushioned surface 58 on a support board 60. The board is pivotally fixed to a cross bar by means of flexible rubber supports 64. The cross bar is secured to upper ends of the frame members.

The ground-engaging surface 52 has a first flat portion 70 and a second flat portion 72 which is inclined relatively to the portion 70. It is evident that the portion 70 can rest on the ground 74 or that a user who is seated on the seat 54 can move his lower legs inwardly towards a lower end 76 of the frame members so that the center of gravity moves to the right and the device then pivots in a clockwise direction so that the flat portion 72 is brought into ground engaging contact with the floor 74 (see FIG. 7).

A person who is seated on the device can do sit-ups, which require different degrees of effort, when the flat portion 70 rests on the ground (FIG. 6) or when the flat portion 72 rests on the ground (FIG. 7). Optionally the user can grip handles 78 on opposed sides of the device to gain some assistance while exercising. The back rest 56 which is pivotally movable to a limited extent relative to the frame members, readily accommodates the changing positions of a user on the device and also allows persons of different physiques to use one device.

A comparison of the devices 10 and 46 shows that the former device allows for a continuous variation of the orientation of a back of a user who is resting on the upper support surface 30 while the device 46 permits this inclination to be varied in step fashion, i.e. in a discontinuous manner, depending upon which portion 70 or 72 rests on the ground 74.

The ground-engaging surface 52 of the device 46 can include a number of flat surfaces each of which will provide a relative degree of stability to the device and a defined orientation of the device, when the device is used. FIGS. 6 and 7 show a possible additional third flat portion 80, in dotted outline, on the ground-engaging surface of the device. Additional flat portions can be provided, according to requirement. It is of course not essential that the stepwise adjustment of the exercise device, relative to the ground, be effected by providing flat portions on the ground-engaging surface of the device. Any other formations or components of appropriate shape can be used to vary the orientation of the body of the exercise device relative to the ground and, with each position to which the device is moved, the resistance level imposed by the device on a user exercising is varied.

With the devices 10 and 46 the orientation of the exercise device is adjustable by causing the device to move relatively to the ground on which the device rests.

Figure 8:
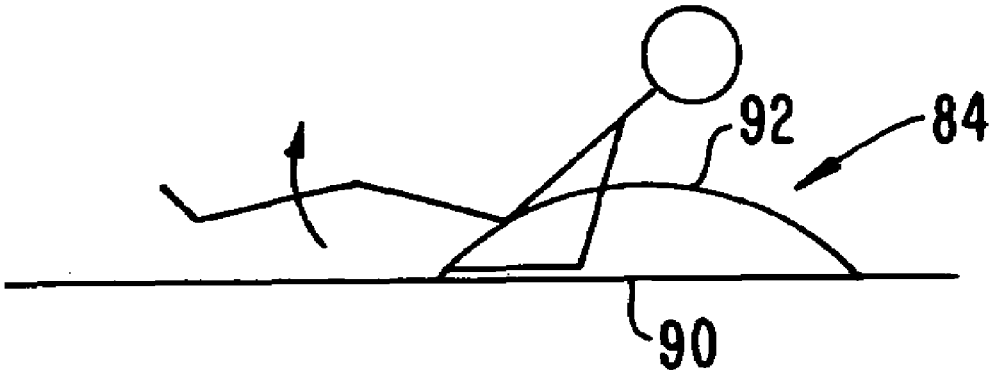
FIGS. 8 and 9 show an exercise device according to a third form of the invention.
Figure 9:
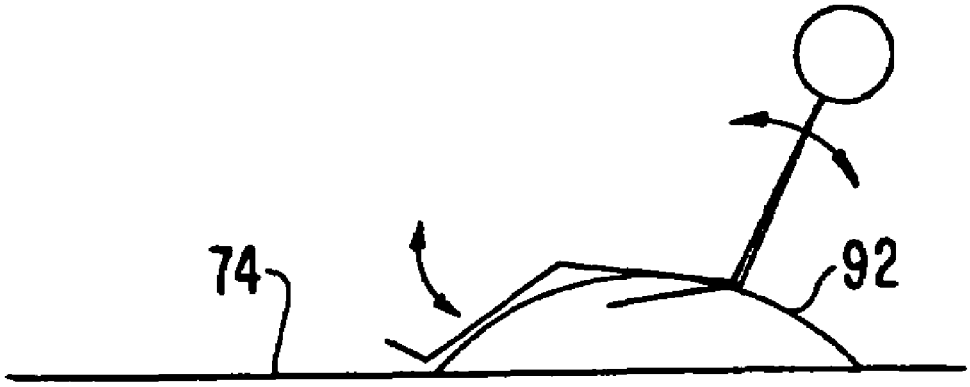

FIGS. 8 and 9 illustrate a static exercise device 84 which can be used to provide similar advantages to those which have been described in connection with FIGS. 1 to 7.

The device 84 has a flat ground-engaging lower surface 90 and an upwardly curving or bulging upper surface 92 which provides a surface upon which a user can recline with the user's back resting on the surface.

If the user is practically seated on the ground, adjacent the device, then the user's back rests against a surface 92 on the left hand side of the device. The user is slightly displaced from an upright sitting position and the degree of effort required to do sit-ups is relatively small (see FIG. 8).

If the user lies with his back on an uppermost portion of the device then the user's back is effectively horizontal and the resistance level in doing sit-ups is increased. The user can however move further to the right so that his back is arched over the upper surface with the user's head facing downwardly to the right of the device. The degree of effort which is required to do sit-ups is then maximized (see FIG. 9).

It is evident from the examples, which have been described herein, that the principles of the invention can be embodied in a variety of exercise devices which have different appearances and structural details. Such variations are however intended to fall within the scope of the present application.

The invention claimed is:

1. An exercise device including an inflatable or solid body comprising:

a first end;

a second end disposed opposite the first end;

a lower convex ground-engaging surface at least part of which is curved outwardly; and an upper surface that includes a first region defining a concave seat-accommodating recess adapted and configured to accommodate a user's buttocks, and a second region defining a convex back-supporting portion adapted and configured to accommodate a user's back thereby allowing a pre-stretch and full contraction of the user's abdominal muscles, wherein the concave seat-accommodating recess is located so that the user, upon changing his/her center of gravity or weight distribution on the upper surface, causes a different portion of the convex ground-engaging surface to contact the ground, and wherein the convex back-supporting portion is located adjacent the second wherein the convex lower ground-engaging surface is curved outwardly in a first direction extending between the first and second ends, and is substantially linear in cross-section taken along a second direction that is transverse to the first direction.

2. The exercise device as claimed in claim 1, further comprising a pair of handles positioned on opposite sides of the body and disposed adjacent the front end.

3. The exercise device as claimed in claim 1, wherein the first and second ends are rounded, and wherein the first end, the rear end, and the concave seat-accommodating recess have substantially the same radius of curvature.

4. The exercise device as claimed in claim 1, wherein the concave seat-accommodating recess is located adjacent the first end so that the user's legs can hang over the front end and contact the ground.

5. The exercise device according to claim 1, wherein the ground-engaging surface is linear when seen in lateral cross section.

* * * * *